US007583810B2

(12) United States Patent
Akino

(10) Patent No.: US 7,583,810 B2
(45) Date of Patent: Sep. 1, 2009

(54) FIXING UNIT FOR MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 808 days.

(21) Appl. No.: 11/246,191

(22) Filed: Oct. 11, 2005

(65) Prior Publication Data

US 2006/0078147 A1 Apr. 13, 2006

(30) Foreign Application Priority Data

Oct. 13, 2004 (JP) ..... 2004-298615

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/363; 381/361; 381/362; 381/366

(58) Field of Classification Search ..... 381/363
See application file for complete search history.

(56) References Cited

U.S. PATENT DOCUMENTS 3,783,175 A * 1/1974 Timmons ..... 174/500
3,787,605 A * 1/1974 Van Gessel et al. ..... 174/500

* cited by examiner

*Primary Examiner*—Curtis Kuntz
*Assistant Examiner*—Matthew Eason
(74) *Attorney, Agent, or Firm*—Manabu Kanesaka

(57) ABSTRACT

A fixing unit for a microphone capable of easily changing a direction in which a microphone cable is drawn without removing a connector is provided. A slit 24 for drawing a microphone cord C is provided from a top end to bottom end of a tubular fixing sleeve 22 fitted into a through hole 53 of a base 51 and a guide ring 19 is also provided with a notch 19*a* for drawing part of the microphone cord.

4 Claims, 7 Drawing Sheets

FIXING UNIT FOR MICROPHONE

TECHNICAL FIELD

The present invention relates to an adapter-mount system fixing unit for a microphone, and more particularly, to a technique of a fixing unit for a microphone which allows, when fixing the microphone to a base such as a desk, the direction of drawing a microphone cord to be easily changed without removing a connector from the microphone cord.

BACKGROUND ART

Microphones are used to allow a large audience to listen to the voice of a speaker through speakers at various international conferences or lecture presentations. As a microphone used in such cases, a goose neck type microphone (hereinafter simply referred to as "microphone") which allows a speaker to freely bring a microphone unit close to his/her mouth using a flexible support pipe by hand is often used.

As shown in FIG. 5 and FIG. 7, this type of microphone 1 has a slim appearance consisting of a flexible support pipe 3, to an end of which a microphone unit 2 is attached, and a cable C connected to and drawn from a power module section (not shown) at the other end of the support pipe 3.

The following two methods are available to fix the microphone 1 to a table. As shown in FIG. 6 and FIG. 8, according to a first method, a tubular fixing sleeve 6 is inserted into a through hole 54 provided in a base 51 such as a desk beforehand. The fixing sleeve 6 has a length protruding from both ends of the base 51, on the outer surface of which a male thread is formed. One end 6*a* protrudes from the base 51 on a surface 52 side, the other end 6*b* protrudes from the base 51 on a back 53 side and a fixing ring 7 is screwed in at the other end 6*b* via a washer 8.

A lock ring 5 for supporting a flange section 4 provided on a base end side of the support pipe 3 of the microphone 1 is screwed into the fixing sleeve 6 at the one end 6*a* (top end) of this fixing sleeve 6. This causes the microphone 1 to be fixed to the base 51 (this method is called "adapter-mount system").

According to a second method (not shown), a fixing member having a female connector is embedded in a base beforehand and a male connector directly attached to a bottom end of a support pipe of a microphone is inserted into a male connector of the fixing member to thereby fix the microphone to the base through one-touch simple operation (this method is called a "quick-mount system."

Another mode is a fixing device for a microphone of a universal type which allows a microphone to be fixed using both an adapter-mount system and a quick-mount system as shown in, for example, Patent Document 1 (Japanese Patent Application Publication No. 2000-102084) proposed by the applicant of the present invention.

However, these methods have the following problems. That is, with regard to cabling of a microphone cord C, any one of the following two methods is adopted; in the case of the adapter-mount system shown in FIG. 5 and FIG. 6, since the power module section (not shown) is installed in a different unnoticeable place, according to the situation in which the microphone 1 is installed, the microphone cord C is conventionally drawn sideward from an outlet 3*a* provided beforehand in the support pipe 3 on the base end side by letting it crawl on the base 51, or the microphone cord C is made to penetrate the base 51 through the fixing sleeve 6 from the bottom of the support pipe 3 of the microphone 1 installed as shown in FIG. 7 and FIG. 8 and pulled out from the bottom of the base 51.

However, when the microphone 1 is shipped, as shown in FIG. 5, since the microphone cord C is drawn sideward from the outlet 3*a* of the support pipe 3 of the microphone 1, in order to make the microphone cord C penetrate the base 51 from the bottom of the support pipe 3 of the microphone 1 and pull out the microphone cord C as shown in FIG. 7, it is necessary to temporarily remove a connector J attached beforehand to one end of the microphone cord C as shown in FIG. 5 to FIG. 8. After this, the microphone cord C is drawn back into the support pipe 3 via the outlet 3*a*, made to penetrate the base 51 through the fixing sleeve 6, pulled out to the back 53 side and then the connector j is reconnected, which involves complicated assembly work.

SUMMARY OF THE INVENTION

The present invention has been implemented to solve the above described problems and it is an object of the present invention to provide a fixing unit for a microphone which allows the direction in which an adapter-mount system microphone cable is drawn to be easily changed.

In order to attain the above described object, the present invention is provided with various features as will be shown below. The present invention is characterized by including a tubular fixing sleeve attached to a through hole of a base, a lock ring having a microphone unit at one end for fixing a support pipe through which a microphone cord passes to a top end of the fixing sleeve, and a guide ring put around an outer perimeter of the fixing sleeve and interposed between the fixing ring and the base, wherein the fixing sleeve is provided with a slit formed in radial direction for drawing the microphone cord out of the bottom end of the support pipe to the outside of the fixing sleeve and the guide ring is further provided with a notch for drawing out the microphone cord.

According to this, since both the fixing sleeve and the lock ring are each provided with a slit and a notch from which the microphone cord is drawn out, when the microphone cord is changed to the top surface side of the base, it is only necessary to draw the microphone cord out of the notch. When the microphone cord is drawn out to the back side, it is possible to easily change the drawing direction by only temporarily taking out the fixing sleeve, incorporating the microphone cord into the support pipe, sending the connector together with the microphone cord below the base and passing the fixing sleeve through the base again.

As a more preferable mode, the above described guide ring preferably has a thickness in radial direction equivalent to or greater than an outer diameter of the microphone cord.

According to this mode, the thickness (length) in radial direction of the guide ring is equivalent to or greater than the outer diameter of the microphone cord, which prevents the microphone cord drawn out of the slit of the fixing sleeve from being strongly pressed between the lock ring and base and allows the microphone cord to be drawn out above the base.

DETAILED DESCRIPTION

Figure 1:
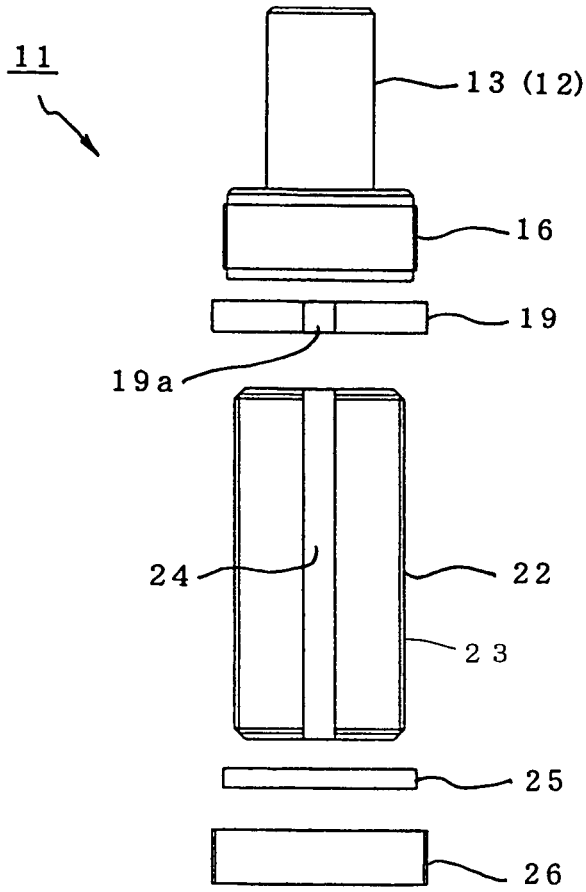
FIG. 1 is an exploded front view showing main components of an example of a fixing unit of the present invention.
Figure 2A:
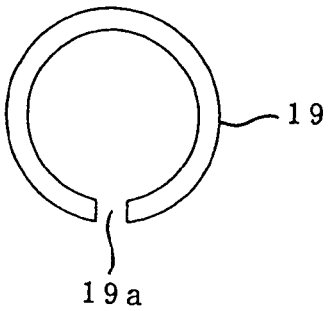
FIG. 2A is a plan view of the guide ring shown in FIG. 1.
Figure 2B:
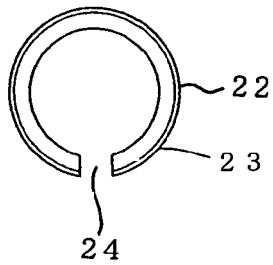
FIG. 2B is a plan view of the fixing sleeve shown in FIG. 1.
Figure 3:
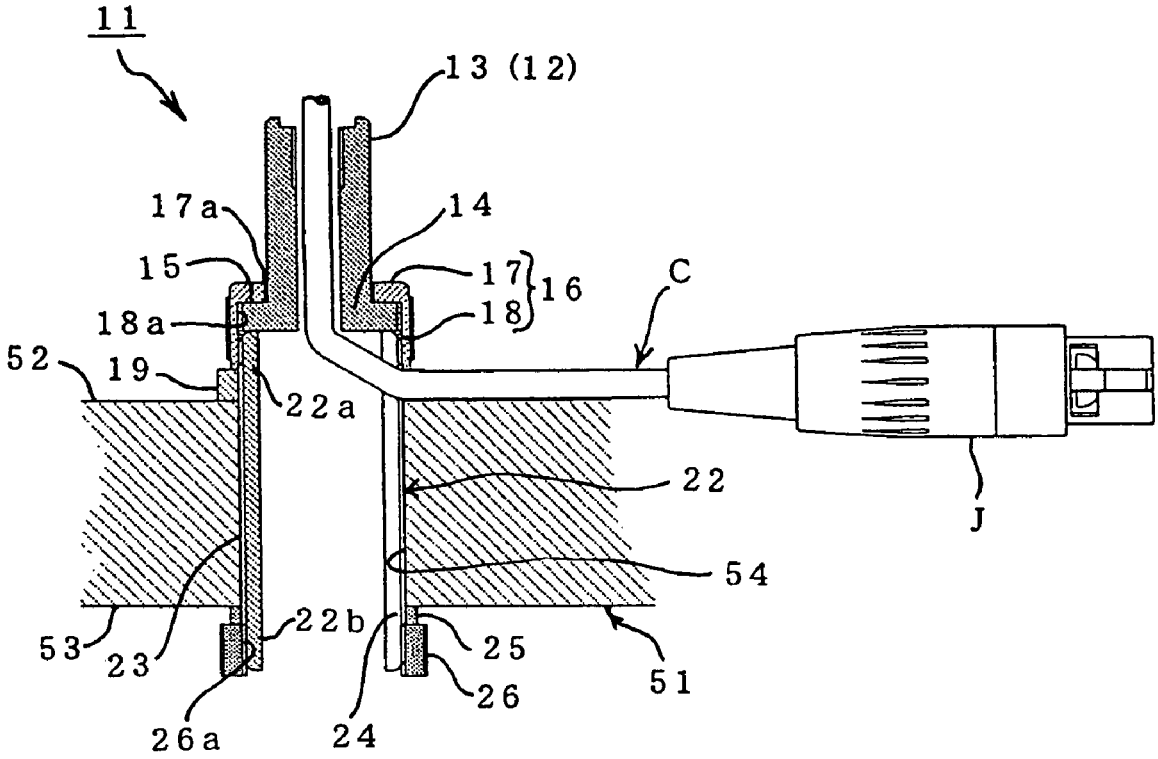
FIG. 3 is an enlarged cross-sectional view of main components of a first example of drawing of the microphone cord.
Figure 4:
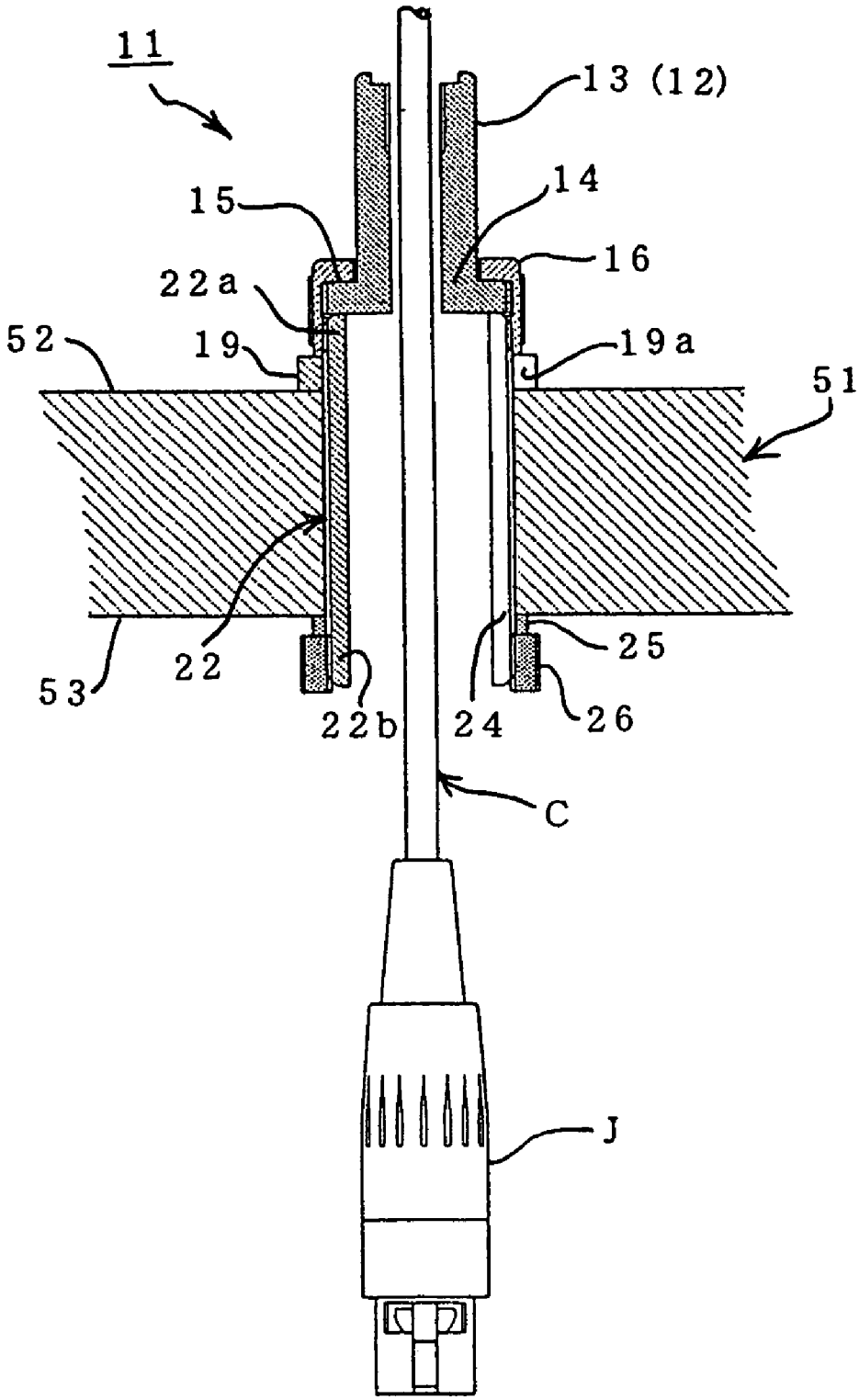
FIG. 4 is an enlarged cross-sectional view of main components of a second example of drawing of the microphone cord.

FIG. 1 illustrates an embodiment of the present invention with main components shown in an exploded view, FIG. 2A is a plan view of the guide ring shown in FIG. 1 and FIG. 2B is a plan view of the fixing sleeve shown in FIG. 1. Furthermore, FIG. 3 is an enlarged cross-sectional view of main components of a first example of drawing of the microphone cord according to the present invention and FIG. 4 is an enlarged cross-sectional view of main components of a second example of drawing of the microphone cord according to the present invention.

According to these figures, a fixing unit 11 for a microphone 12 is at least provided with a tubular fixing sleeve 22 fitted in a through hole 54 formed in a base 51, a lock ring 16 attached to a base end side of a support pipe 13 having a microphone unit 2 (see FIG. 5) at one end thereof and fixed to part of the fixing sleeve 12 and a guide ring 19 inserted along the outer perimeter of the fixing sleeve 22 and interposed between the lock ring 16 and base 51.

Here, the base 51 is preferably one having a flat top plate such as a table or conference table or may also be one having a vertical flat surface such as a wall and can be arbitrarily modified according to specifications if it at least allows the through hole 54 through which the fixing sleeve 22 can pass to be formed.

The fixing sleeve 22 is made up of a cylindrical body which is made of an alloy of brass or the like and a male thread 23 is formed on the outer surface thereof. The inner diameter of the fixing sleeve 22 has at least a size that allows a connector J attached to one end of the microphone cord C to pass therethrough. The fixing sleeve 22 has a slit 24 formed throughout the length in radial direction thereof. The slit 24 has a width that allows the microphone cord C drawn out of the support pipe 13 to pass therethrough.

The fixing sleeve 22 is screwed into the through hole 54 and provisionally fixed with one end 22*a* protruding from a surface 52 of the base 51 and the other end 22*b* protruding from a back 53 of the base 51 by a predetermined length. A stopper 26 is attached to the other end 22*b* of the fixing sleeve 22 via a washer 25. The stopper 26 is bolt-shaped with a female thread 26*a* formed in the center and screwed into a male thread 23 of the fixing sleeve 22 up to a position at which it contacts the back 53 of the base 51.

Figure 5:
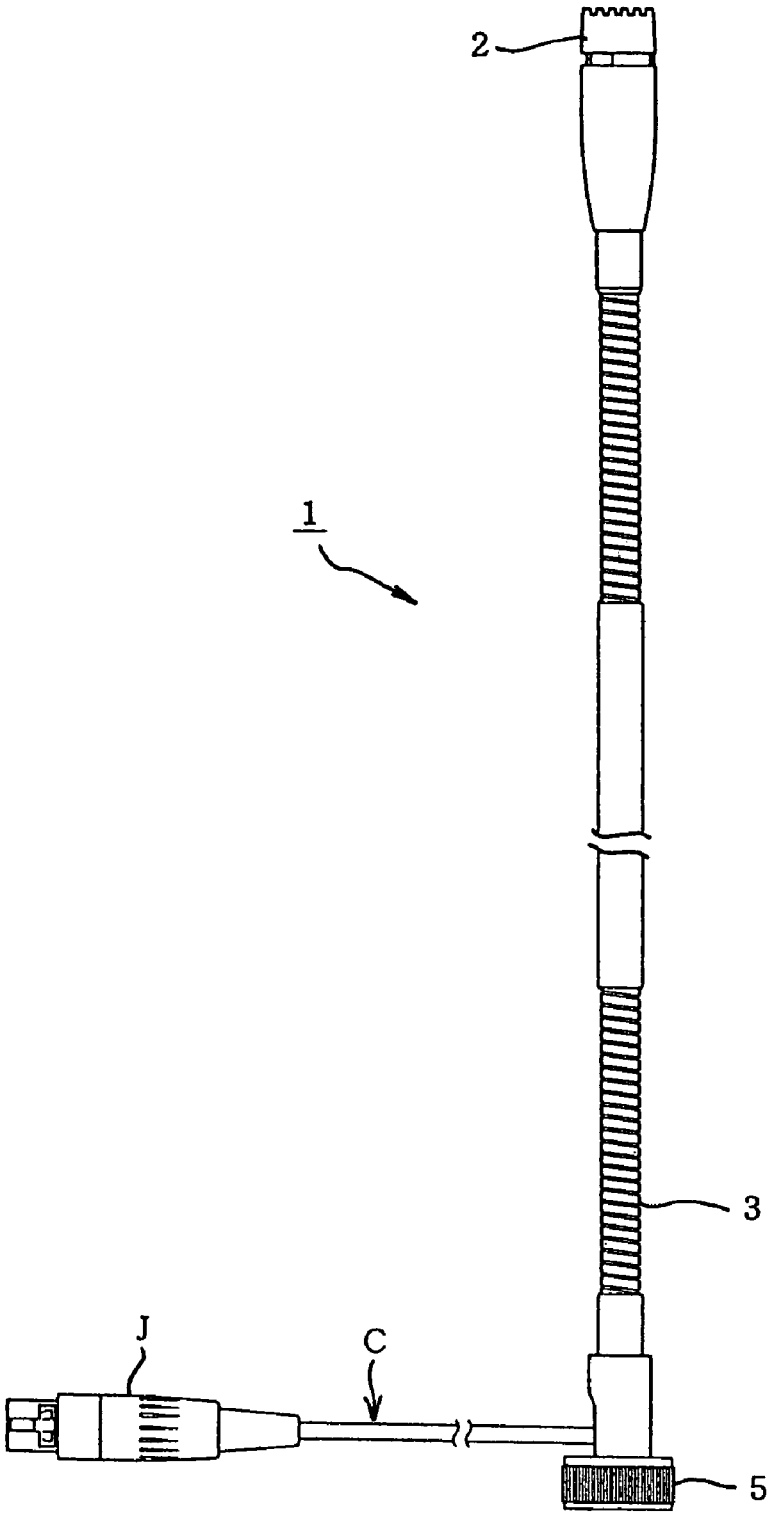
FIG. 5 PRIOR ART
FIG. 5 illustrates a first drawing example of a conventional microphone cord.
Figure 6:
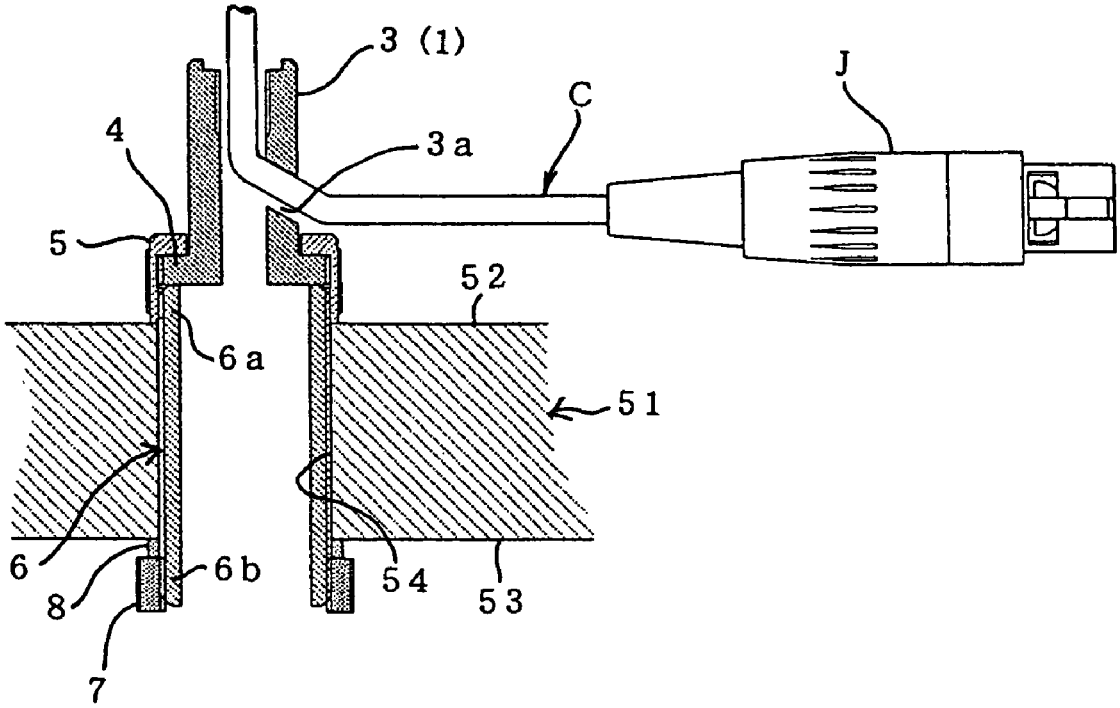
FIG. 6 PRIOR ART
FIG. 6 is an enlarged cross-sectional view of the example shown in FIG. 5 turned by 180 degrees.
Figure 7:
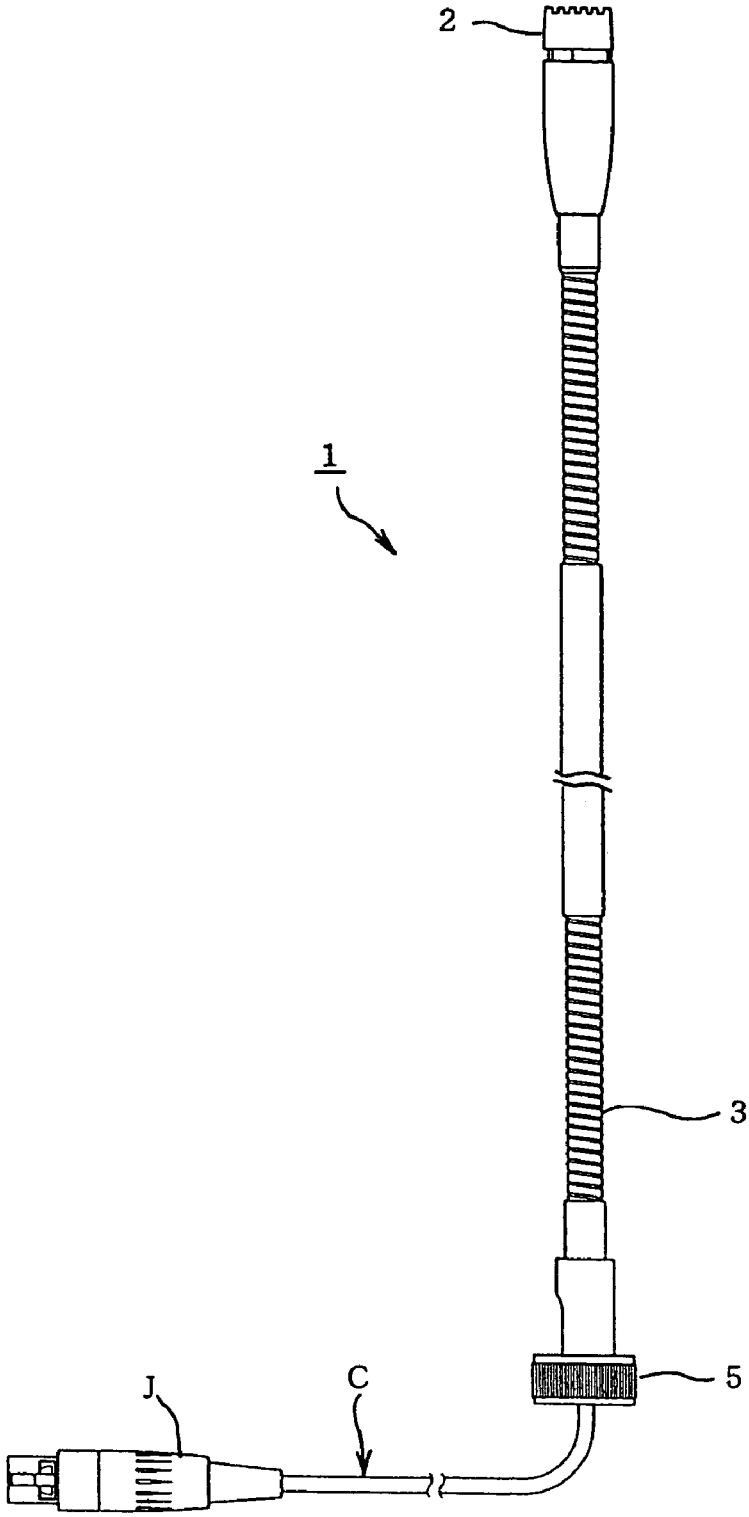
FIG. 7 PRIOR ART
FIG. 7 illustrates a second drawing example of the conventional microphone cord.
Figure 8:
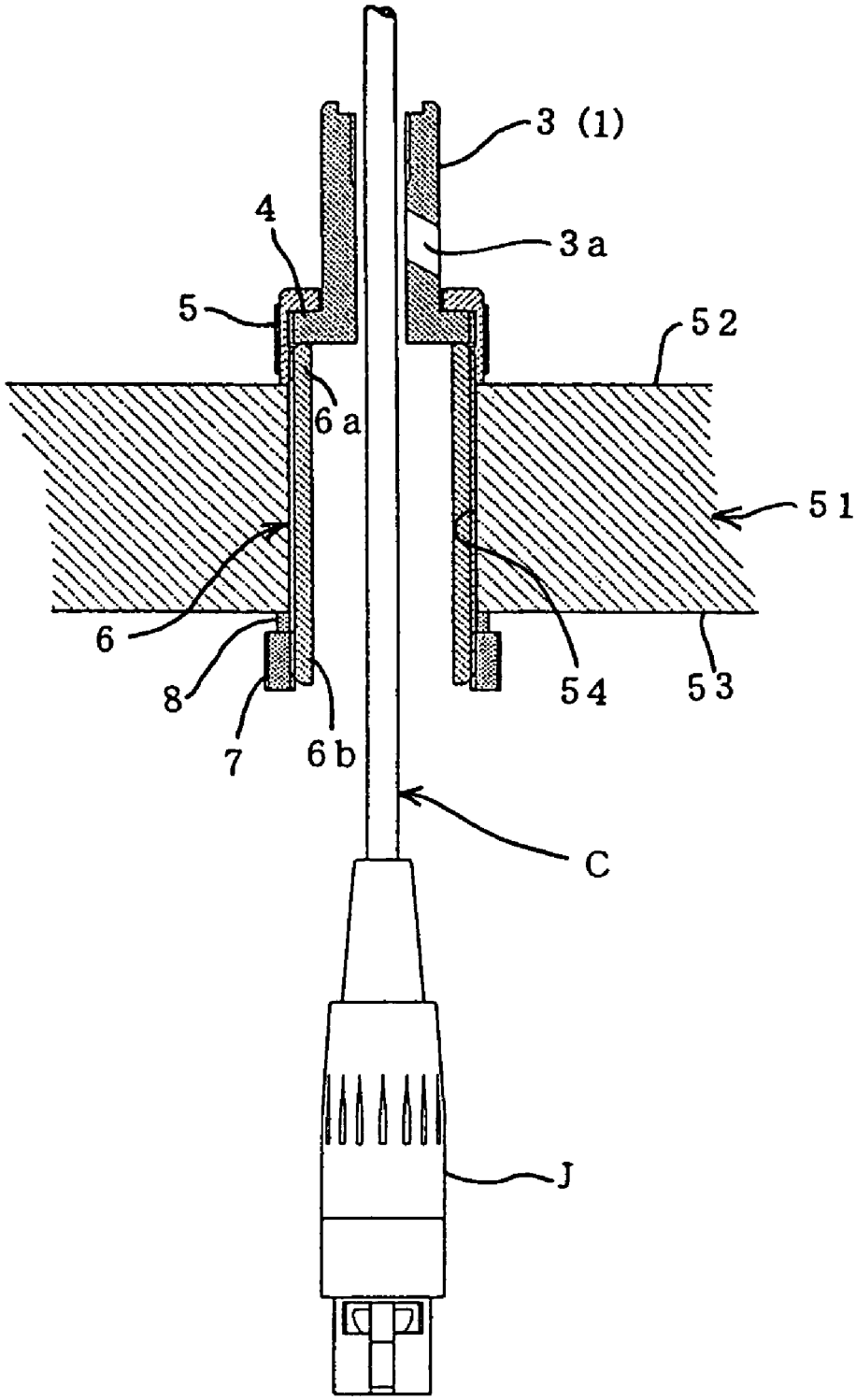
FIG. 8 PRIOR ART
FIG. 8 is an enlarged cross-sectional view of the example shown in FIG. 7 turned by 180 degrees.

As in the case of the one shown in FIG. 5, the support pipe 13 is made up of a flexible pipe that can be freely bent and a telescopic straight tube is connected to part thereof. A microphone unit 2 is attached to one end of the support pipe 13 and allowed to be connected to a power module section (not shown) installed in a different place through the microphone cord C drawn out of the microphone unit 2.

As shown in FIG. 3, the support pipe 13 is provided with a flange section 14 having substantially the same diameter as the outer diameter of the fixing sleeve 22. The flange section 14 constitutes a stopper for the lock ring 16 attached along the outer perimeter in a freely rotatable manner.

The lock ring 16 has a substantially horseshoe-shaped section made up of a top plate section 17 having a circular hole 17*a* through which the support pipe 13 passes in the center thereof and a peripheral wall section 18 formed substantially vertically from the outer edge of the top plate section 17. A female thread 18*a* mating with the male thread 23 of the fixing sleeve 22 is formed on the inner surface of the peripheral wall section 18.

The guide ring 19 is made up of a ring body having a larger inner diameter than the outer diameter of the fixing sleeve 22 and has a length (thickness) in radial direction equivalent to or greater than the outer diameter of the microphone cord C. A notch 19*a* is formed in part of the guide ring 19 and the guide ring 19 is C-figured as shown in FIG. 2A in a plan view. The microphone cord C can be drawn from this notch 19*a* to the surface 52 side of the base 51.

Next, the operation of the present invention having the above described structure will be explained focused on a case where the direction in which the microphone cord C is drawn shown in FIG. 3 is changed to the direction in which the microphone cord C is drawn shown in FIG. 4. The fixing sleeve 22 is fixed to the base 51 and the female thread 26*a* of the stopper 26 is screwed at the other end 22*b* thereof.

The support pipe 13 can be fixed to the fixing sleeve 22 by mating the female thread 18*a* of the lock ring 16 attached to the flange section 14 with the one end 22*a* of the fixing sleeve 22.

The microphone cord C drawn from the lower part of the support pipe 13 is drawn sideward through the slit 24 of the fixing sleeve 22 and can be drawn out of the surface of the base 51 via the notch 19*a* of the guide ring 19.

At this time, since the guide ring 19 is formed to a thickness equivalent to or greater than the outer diameter of the microphone cord C, even when the lock ring 16 is strongly screwed into the fixing sleeve 22 and press-contacted against the guide ring 19, the microphone cord C drawn out of the slit 24 of the fixing sleeve 22 can be smoothly guided to the surface 52 side of the base 51 via the notch 19*a* without being strongly pressed against the base 51 side. FIG. 3 shows how the support pipe 13 is attached with the lock ring 16 screwed in the fixing sleeve 22 on the one end 22*a* side in such a state.

Next, when the microphone cord C is drawn below the base 53 on the back 53 side to change the drawing direction from the state in FIG. 3, the stopper 26 is loosened, removed together with the washer 25 from the fixing sleeve 22 on the other end 22*b* side and the fixing sleeve 22 is removed from the base 51 on the surface 52 side.

This allows the microphone cord C to be immediately sent into the fixing sleeve 22 via the notch 19*a* of the guide ring 19 and the slit 24 of the fixing sleeve 22. That is, the microphone cord C can be immediately put in place inside the fixing sleeve 22 without the need to remove the connector J.

Since the connector J can be sent to the back 53 side through the through hole 54 of the base 51, it is possible to send the connector J toward the back 53, fit the fixing sleeve 22 into the through hole 54, screw in the stopper 26 at other end 22*b* via the washer 25 to thereby draw the microphone cord C below the base 53 on the back 53 side as shown in FIG. 4.

In this way, it is possible to change the direction in which the microphone cord C is drawn extremely easily without complicated work of removing and reconnecting the connector J.

The present invention has been explained so far based on illustrated examples, but the specific structure thereof is not limited to this. In this example, there is only one guide ring 19, but it is also possible to put a plurality of rings one atop another so as to have a thickness substantially equivalent to or greater than the outer diameter of the microphone cord C. Furthermore, the support pipe 13 and lock ring 16 may also be integrated as one piece as required.

The present application is based on, and claims priority from, Japanese Application Serial Number JP2004-298615, filed Oct. 13, 2004, the disclosure of which is hereby incorporated by reference herein in its entirety.

The invention claimed is:

1. A fixing unit for a microphone comprising:

a tubular fixing sleeve adapted to be attached to a through hole of a base;

a lock ring engaging a top end of said fixing sleeve for fixing a support pipe to the fixing sleeve, said support pipe having a microphone unit at one end and a microphone cord passing therethrough; and a guide ring put around an outer perimeter of said fixing sleeve to be interposed between said lock ring and said base, wherein said fixing sleeve is provided with a slit extending throughout an entire length thereof for drawing said microphone cord out of a bottom end of said support pipe to a side of said fixing sleeve, and said guide ring is provided with a notch for allowing said microphone cord to pass therethrough so that the microphone cord located in the fixing sleeve is drawn out of the sleeve through the slit and the notch.

2. The fixing unit for a microphone according to claim 1, wherein said guide ring has a thickness in an axial direction equivalent to or greater than an outer diameter of the microphone cord.

3. The fixing unit for a microphone according to claim 2, wherein said notch extends throughout an entire axial length of the guide ring.

4. The fixing unit for a microphone according to claim 3, wherein said fixing sleeve and said guide ring have a C-shape when viewing along an axial direction.

* * * * *